US007858928B2

(12) United States Patent
Knapp

(10) Patent No.: US 7,858,928 B2
(45) Date of Patent: Dec. 28, 2010

(54) NANOSTRUCTURED SURFACES AS A DUAL IONIZATION LDI-DESI PLATFORM FOR INCREASED PEPTIDE COVERAGE IN PROTEOMIC ANALYSIS

(75) Inventor: Daniel R. Knapp, Charleston, SC (US)

(73) Assignee: The United States of America Department of Health and Human Services, Washington, DC (US)

( * ) Notice: Subject to any disclaimer, the term of this patent is extended or adjusted under 35 U.S.C. 154(b) by 123 days.

(21) Appl. No.: 11/858,859

(22) Filed: Sep. 20, 2007

(65) Prior Publication Data

US 2008/0087811 A1 Apr. 17, 2008

Related U.S. Application Data

(60) Provisional application No. 60/826,241, filed on Sep. 20, 2006.

(51) Int. Cl.
*H01J 49/04* (2006.01)

(52) U.S. Cl. ..... 250/282; 250/281

(58) Field of Classification Search ..... None
See application file for complete search history.

(56) References Cited

U.S. PATENT DOCUMENTS

| | | | | |
|---|---|---|---|---|
| 6,403,338 | B1 * | 6/2002 | Knapp et al. | 435/91.2 |
| 7,473,298 | B2 * | 1/2009 | Suda et al. | 95/64 |
| 7,534,338 | B2 * | 5/2009 | Hafeman et al. | 205/288 |
| 2005/0116161 | A1 * | 6/2005 | Hafeman et al. | 250/282 |
| 2008/0087811 | A1 * | 4/2008 | Knapp | 250/282 |
| 2008/0277578 | A1 * | 11/2008 | Ferrari et al. | 250/288 |
| 2009/0155678 | A1 * | 6/2009 | Less et al. | 429/144 |

OTHER PUBLICATIONS

Okuno et al., "Requirements for Laser-Induced Desorption/Ionization on Submicrometer Structures", Analytical Chemistry, vol. 77, No. 16, Aug. 15, 2005, pp. 5364-5369.*

* cited by examiner

*Primary Examiner*—David A Vanore
(74) *Attorney, Agent, or Firm*—Pabst Patent Group

(57) ABSTRACT

Embodiments of the invention include methods and devices for the analysis of proteins utilizing a gold coated nanoporous alumina surface for dual ionization mode mass spectrometric analysis using desorption electrospray ionization (DESI) and laser desorption ionization (LDI). Combined use of DESI and LDI gives increased sequence coverage in peptide mixture analysis from a single sample preparation.

5 Claims, 6 Drawing Sheets

(a)

(b)

NANOSTRUCTURED SURFACES AS A DUAL IONIZATION LDI-DESI PLATFORM FOR INCREASED PEPTIDE COVERAGE IN PROTEOMIC ANALYSIS

PRIORITY CLAIM

This application claims the benefit of U.S. Provisional Patent Application Ser. No. 60/826,241 filed on Sep. 20, 2006 entitled "Nanostructured Surfaces as a Dual Ionization LDI-DESI Platform for Increased Peptide Coverage in Proteomic Analysis" by Daniel R. Knapp, which is incorporated by reference herein as if rewritten in full.

FEDERAL SUPPORT CLAUSE

This invention was made with government support under grant number N01-HV-28181 awarded by the National Institutes of Health. The government has certain rights in the invention.

BACKGROUND OF THE INVENTION

Embodiments of this invention pertain to analytical methods and devices for proteomics. Proteomics is the large-scale study of proteins, particularly their structures and functions.

Building upon the successes of the various genome sequencing projects, the new frontier of basic biological research is proteomics, the study of the repertoire of expressed proteins in a living system encoded by the genome of the cells. It is estimated that through various modes of splicing and posttranslational modifications, the human genome gives rise to hundreds of thousands of different protein forms. These huge numbers of species can also be present in widely varying amounts; for example, just the known proteins present in plasma range in concentrations over more than ten orders of magnitude [1]. Identifying and quantitating these very large numbers of proteins at widely varying concentration levels presents an enormous analytical challenge.

BRIEF SUMMARY OF THE INVENTION

A brief description of certain embodiments of the invention: A gold coated nanoporous alumina surface was utilized for dual ionization mode mass spectrometric analysis using desorption electrospray ionization (DESI) and laser desorption ionization (LDI). DESI and LDI from the nanoporous alumina surface was compared with conventional electrospray ionization (ESI) mass spectrometry and matrix assisted laser desorption ionization (MALDI) for analysis of a mixture of tryptic digested peptides. Combined use of DESI and LDI gave greater peptide coverage than either method alone and greater peptide coverage than combined MALDI and ESI. This dual ionization platform can yield an increased sequence coverage in peptide mixture analysis from a single sample preparation.

DESCRIPTION OF FIGURES A1

FIG. 1*a* is a mass spectra of bovine catalase (0.35 mg/ml) using MALDI.

FIG. 1*b* is a mass spectra of bovine catalase (0.35 mg/ml) using ESI.

FIG. 1*c* is a mass spectra of bovine catalase (0.35 mg/ml) using LDI.

FIG. 1*d* is a mass spectra of bovine catalase (0.35 mg/ml) using DESI MS methods.

DETAILED DESCRIPTION OF THE INVENTION

Figure 1A:
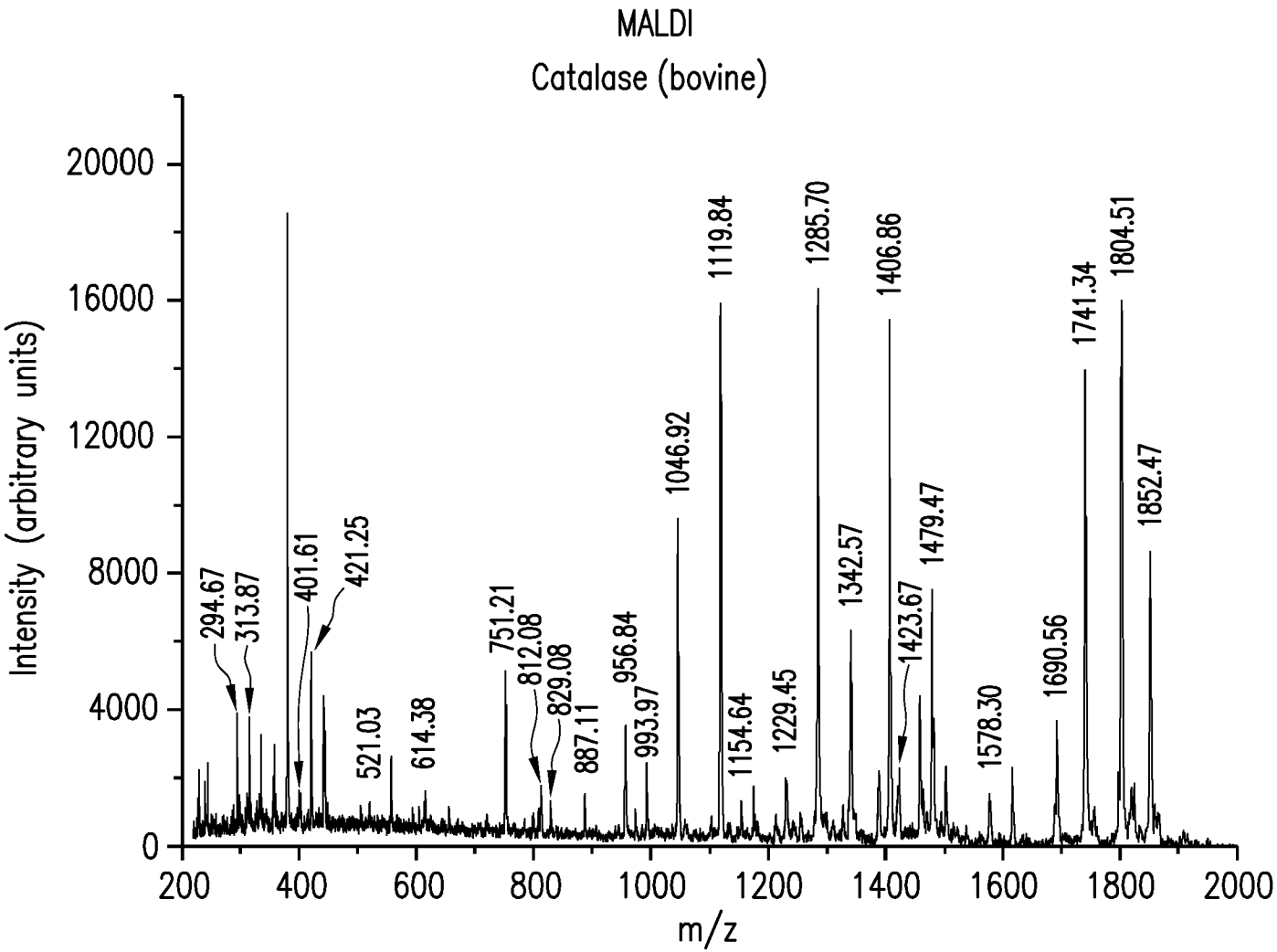
Figure 1B:
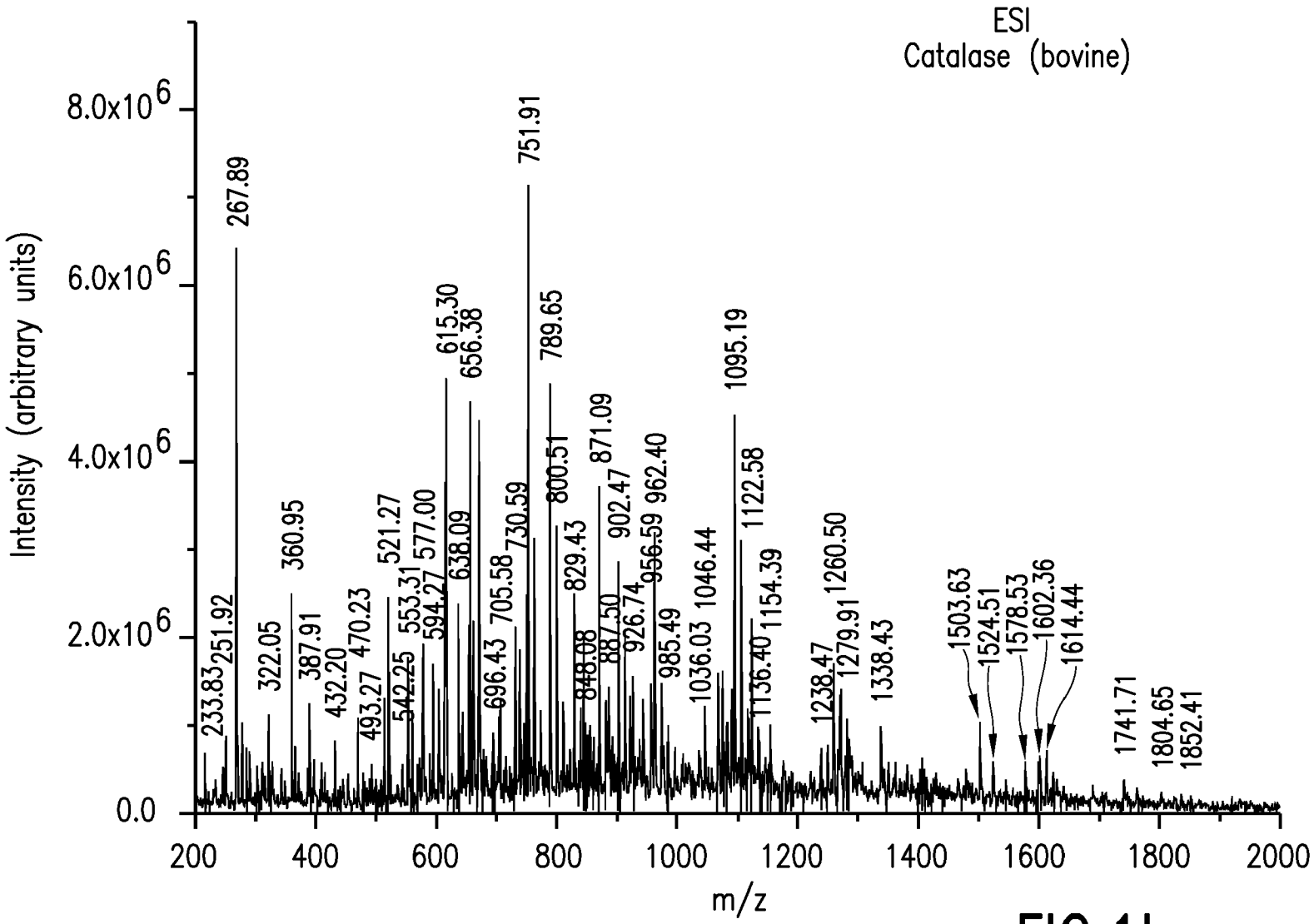
Figure 1C:
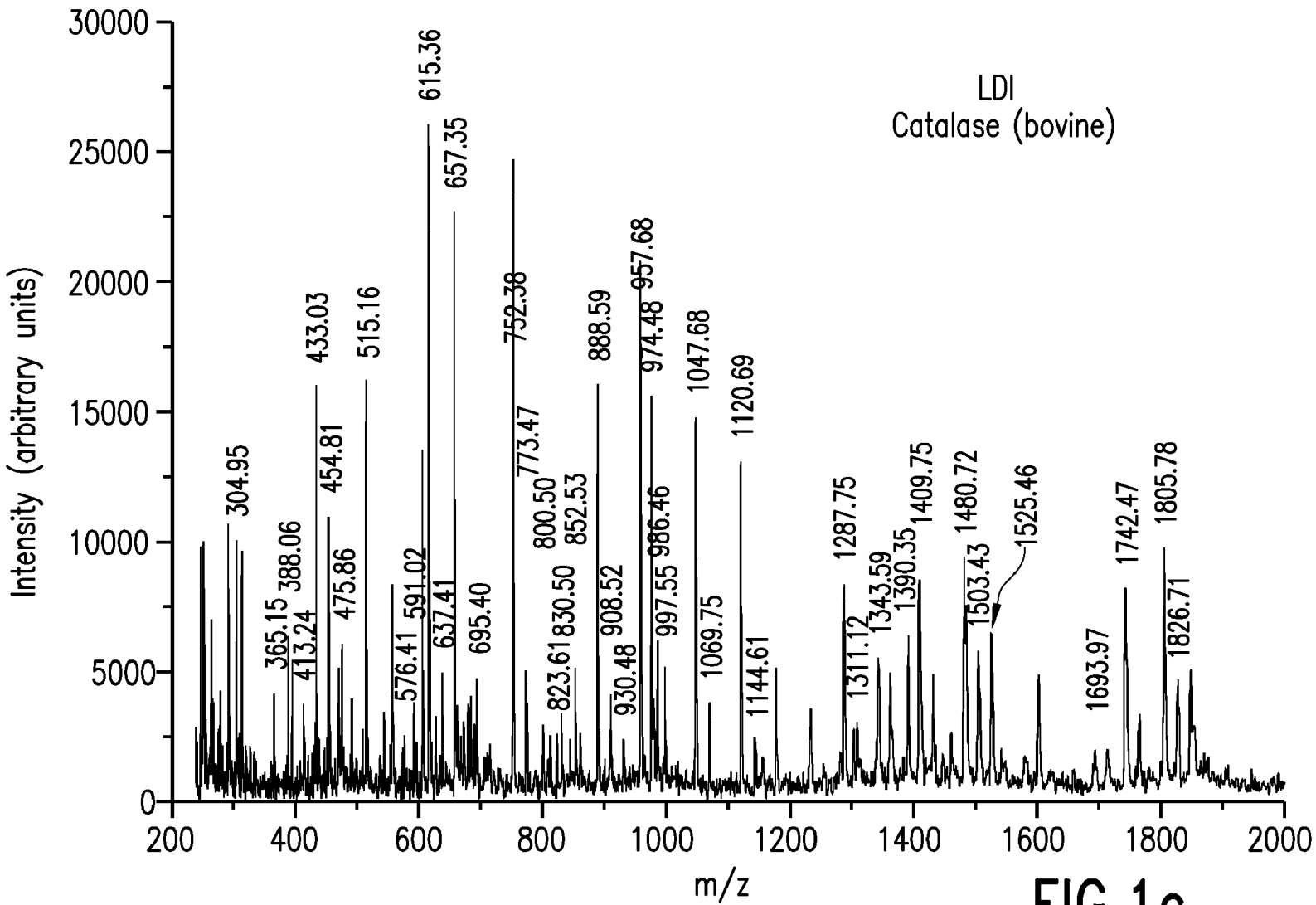
Figure 1D:
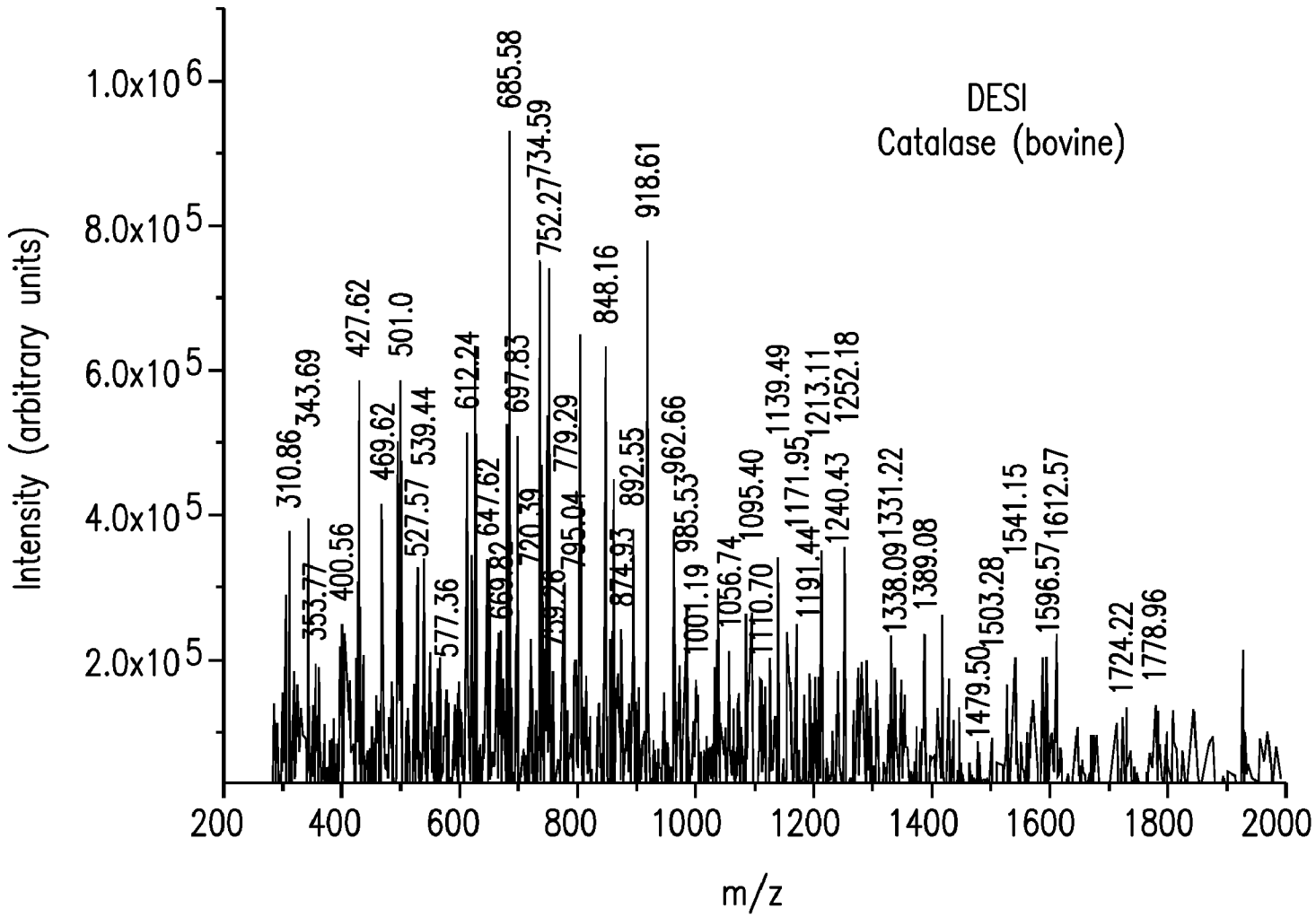

Of the two primary analytical approaches used in proteomics, two dimensional gel electrophoresis (2DE)-based and two dimensional liquid chromatography (2D-LC)—based, the latter is being increasingly applied; most commonly in the form of "shotgun" proteomics where the protein mixture is digested at the outset, and the resulting more complex peptide mixture separated by multiple stages of liquid chromatography (LC) prior to mass spectrometry (MS) analysis. In multidimensional LC—based analysis, more components can be observed by improved separation of the components (i.e. increasing the "separation space" and sampling more fractions), albeit at the expense of increased methodological complexity, time, and effort. Another way to observe more components of a separated mixture is to increase the number of components observed in the fractions collected in a given separation, i.e. increasing the "depth" of analysis. The objective of the work described here is the development of a new platform for increasing depth of analysis by applying different MS ionization modes to the same sample, thereby enabling observation of complementary subsets of peptide components and observation of more total components that is possible with a single mode of ionization.

The two most common MS ionization modes used in proteomic analysis are ESI and MALDI. It is well known that ESI and MALDI analysis of a peptide mixture usually results in observation of overlapping complementary sets of peptides, and that application of both modes gives significantly increased coverage of the peptides present in a sample compared to either method alone [2-6]. For example, in one of the first such reports [2], it was shown that addition of MALDI analysis to ESI LC/MS/MS analysis of the 39S subunit of bovine mitochondrial ribosomes yielded a 22% increase in the total number of proteins identified. However, conventional ESI and MALDI analysis require different sample formats (liquid solution for ESI and dried matrix-co-crystallized solid for MALDI) requiring significant additional sample and effort to carry out both modes of analysis.

In recent years, matrix-free LDI and DESI MS methods have emerged as promising alternatives to conventional MALDI and ESI respectively. Although MALDI is a well-established technique with many advantages, the use of matrix to form a homogenous co-crystallization with analyte molecules to transfer the energy received from the laser makes it a complex process. Moreover, matrix background interference also generates significant background ion signals that limit the detection of low mass molecules (<600 Da). This presents a considerable need to develop novel platforms for matrix-free LDI. Matrix-free surfaces developed to date include, nanoporous silicon [7, 8], silicon dioxide [9, 10], titanium oxide [11], aluminum oxide [12, 13], polymer monolith [14] and structured carbon surfaces like carbon nanotubes [15]. Amongst these surfaces, desorption ionization from porous silicon (DIOS) is most well known [7] and is also available commercially. However, storage of DIOS chips for long-term use is critical in that the silicon surface tends to oxidize in air, which alters its performance. LDI from metal coated porous alumina surfaces has shown promising results in peptide analysis [12, 13].

DESI, first reported by Cooks and co-workers [16] is another relatively new MS analysis method that gives spectra similar to ESI. DESI has been demonstrated for both polar and non-polar analytes [16, 17]. DESI allows fast analysis of samples under ambient condition without any sample preparation, which makes this method of potential interest in a wide variety of in-situ analysis. Some of the reported applications of DESI include analysis of explosives from surfaces like plastics, floppy disks, glass, paper, metal, cotton swabs, etc. [18, 19] and also analysis of natural substances (plants [16, 20], urine [21], blood [16], etc.) and pharmaceuticals [16, 22, 23].

DESI produces ions by directing an electrosprayed solvent onto a surface and collecting desorbed ions via a capillary. Performance of DESI analysis is dependent on several factors, such as the spray solvent, its flow rate, incident and collection angles, tip-to-surface distance and the nature of the surface. The most commonly used surfaces for DESI are polymethylmethacrylate (PMMA) and polytetrafluroethylene (PTFE). Further improvements in DESI spectra have been shown by using new surfaces like ultra thin chromatographic plates and porous silicon chips [24].

Embodiments of this invention use nanostructured alumina surfaces to obtain "MALDI-like" spectra by laser desorption ionization (LDI) without the use of conventional MALDI matrix [13], and obtain "ESI-like" MS data from the same sample by use of desorption electrospray ionization (DESI) [25]. As with ESI and MALDI, DESI and LDI analysis of a peptide mixture on the nanostructured alumina surface observes complementary sets of mixture components giving greater peptide coverage that either method alone. This platform can also be used for increasing numbers of fractions as smaller and smaller spots in increasingly dense arrays (potentially many thousands of spots per square cm. as in microarrays) for increased resolution of complex samples, thus it has the potential to contribute to increasing separation space as well. In addition, the platform is "archivable" for later reanalysis of separated samples.

Embodiments of the invention can use other nanostructured surfaces as multiple ionization platforms, and also other modes of ambient ionization for mass spectrometry. Yet another new mode of amibient ionization is "plasma-assisted desorption ionization" (PADI) ref-L. V. Ratcliffe et al., Analytical Chemistry 79(16); 6094-6101, 2007.

Descriptions of alternative surfaces and platforms follows (Note the reference numbers for this section are separately delineated using a numbering scheme different than the bulk of this application. The references for this section are set forth in Appendix B. This section is marked with "Reference Set B" at the beginning and the end of this section.)

<Reference Set B—Beginning>

Proteomic Analysis—Proteomic analysis entails separation of complex mixtures of proteins (and/or peptide fragments), identification of the separated components, and quantitative measurement of the relative amounts in different specimens (e.g. from disease subjects vs. normal control subjects). A variety of methods have been applied to proteomic analysis.

2DE-based Methods—The conventional approach to proteomic analysis has been to separate the mixtures of proteins by 2D gel electrophoresis on the basis of isoelectric point (pI) in one dimension and molecular size in the other. Such separations can yield hundreds or even thousands of spots representing different protein species. Identification of the separated proteins is achieved by excising the gel spots, digesting the proteins in the spots to smaller fragments, identifying the fragments by mass spectrometry, and then associating the fragments with proteins using genomic database information. The limitations of dynamic range in gel-based analyses, the inability to observe low abundance protein species, and the inability to separate certain types of proteins on gels (i.e. very large and very small proteins, proteins at the extremes of pI, and very hydrophobic proteins) have led to major efforts to develop alternative methods.

2DLC-based Methods—A current technology is based upon liquid chromatography (LC) separations followed by mass spectrometry (MS). The most common implementation of this approach is fundamentally different from the 2DE method in that, rather than first separating the protein mixture at the protein level, the entire mixture is digested to peptide fragments at the start. The resulting mixture of peptides is separated by multiple dimensions of LC, typically based upon ionization differences in one dimension and hydrophobicity in another, and the separated components are identified by MS. This approach, often referred to as "shotgun proteomics", has been demonstrated to be capable of observing a larger number of proteins than gel methods.11 In addition, a larger number of low abundance species, as well as important protein classes such as membrane proteins, that are problematic for gels, can be identified. Although information is lost when the protein mixture is digested, the total information yield, in most cases, is greater than with gel-based methods. As a result, LC-based shotgun methods are replacing gel-based methods in many studies. As noted above, shotgun proteomic analysis converts a complex mixture of proteins to an even more complex mixture of fragment peptides. Recent work has demonstrated that the digest mixtures are likely to contain more than an order of magnitude more fragment peptides than would be predicted from the specificity of trypsin.12 This finding further emphasizes the critical need for improved analytical technologies for proteomic analysis. The proposed work is aimed to help to meet that need.

Quantitative Protein Expression Methods—Differential expression analyses to discern differences in the amounts of proteins present in different specimens require quantitative measurements of the proteins. 2DE-based methods usually rely on densitometry measurements of the protein spots, or use of fluorescent dye labeling of the proteins. These methods are limited by the fact that gel spots usually contain multiple proteins. Differential expression studies are increasingly being done using the LC-based approaches in conjunction with heavy isotope labeling and MS analysis. In these methods, a control sample (e.g. a non-disease specimen) is "tagged" with a light isotope label, and the corresponding experimental sample (e.g. a disease specimen) is tagged with a heavy isotope label (or vice versa). The samples are mixed and analyzed by LC-MS to determine the ratio of "light" to "heavy" for each protein. This ratio reflects the relative amounts of proteins present in the control and experimental samples. One such approach, referred to as the "ICAT" (isotope coded affinity tag) method, entails labeling a specific type of amino acid residue [cysteine (Cys) in the original method] with a tag that includes both the isotope label and an affinity tag. The labeled peptide fragments are isolated using the affinity tag.13 The ICAT method works, but involves relatively complex sample workup procedures. Even using ratio measurements, replicate analyses normally vary by 20% or more. The ICAT method suffers several other disadvantages. Practical considerations (including cost) preclude the use of a large excess of the tagging reagent as is normally done in analytical derivatization to drive reactions to completion; thus the yield of the tagging is often less than complete. Second, the affinity isolation is less than complete and is known to suffer interferences from endogenous materials. Finally, proteins without Cys are not observed at all. Observation of only Cys peptides means that proteins must be identified from fewer fragment peptides, leading to less confidence in the final protein identifications. A newer isotope tagging method for differential expression analysis 14 overcomes many of the disadvantages of the ICAT method. The new approach, called iTRAQ™ ("isobaric tags for relative and absolute quantitation") involves use of a reagent with four isotope variants allowing simultaneous analysis of four samples, compared to two with the ICAT method (an eight variant form was also recently announced15). The protein reactive group is an N-hydroxysuccinimide ester that reacts with N-terminal and lysine amino groups. Thus, the method tags essentially all peptides rather than only Cys containing peptides as in the ICAT method. The four variants of the tag have the same mass (145 Da), therefore peptides from the four samples all appear at the same molecular ion mass and yield the same MS/MS fragment ions. This additive effect of the mixed samples serves to increase the overall sensitivity. Quantitation is made possible by the fact that the four tags have different mass reporter groups (masses 114-117) that cleave in the tandem MS (MS/MS) analysis and appear as peaks in a low mass area that is generally free of peaks in peptide MS/MS spectra. The peak area ratios of the 114-117 peaks are used for quantitation. An advantage of the iTRAQ method is that it permits simultaneous analysis of four different specimens or replicate analyses of two different specimens. A disadvantage of the method has been that the reporter peaks appear in a low mass range that is normally not observed in ion trap instruments. The problem can be overcome, however, with a new "pulsed Q dissociation" (PQD) method available in the Thermo linear ion trap or by use of other types of instruments (i.e. QTOF or TOF-TOF).

A significant weakness of conventional shotgun methods (including iTRAQ), where MS and MS/MS data are being simultaneously collected by online ESI-MS, is that the same peptides are not consistently observed in the analysis. This occurs because the method is not capable of exactly replicating LC retention times and scan initiation times; and, during the MS/MS analysis, some of the peptides eluting from the LC separation are missed. Since the LC elution times are not exactly reproducible, different peptides can be missed in different analyses, and even in replicate analyses of the same specimen. One solution is to perform multiple analyses of the same sample 16; but this seriously reduces throughput of an already lengthy analysis, and there may not be sufficient quantity of specimen for multiple analyses. The use of offline separation and fraction collection for subsequent MALDI analysis offers some improvement since it removes the time limitations of online analyses. With "smart" data acquisition, excluding reanalysis of already identified peptides, the improvements are even greater.17 MALDI tends to observe a different subset of peptides compared to ESI for a given point in the LC elution due to it's particular competitive suppression characteristics, and can also exhibit variability in the observed peptides since the discrete sampling can result in differences in the peptide mixtures in the individual fraction spots. As a result, the differences in peptide competitive suppression effects can result in differences in the observed peptides in different LC runs even in the absence of the analysis time limitation. The proposed work will help solve this problem by enabling the observation of more peptides in each fraction spot; and the development of capability to analyze smaller fraction spots will further alleviate the problem by enabling higher resolution fraction collection, which will reduce the complexity of the individual fraction mixtures.

Increasing use is also being made of the label-free or "tagless" approach to quantitative proteomic analysis.18 In this approach, samples are analyzed individually by LC-MS, and the areas of aligned peptide molecular ion peaks compared between the analyses. Differences in expression are observed as peak ratios that are statistically different from the mean ratio.19 Since this approach uses initial LC-MS analysis, it does not suffer the problems associated with online MS/MS analysis, but it is still subject to the limitations of analysis depth and separation space. Thus, the proposed development will also be applicable to label-free quantitative methods as well.

Shotgun Proteomic Analysis Using ESI and MALDI MS—The original report of the shotgun method ("multidimensional protein identification technology" ["MuDPIT"] by the Yates laboratory employed online multidimensional LC-ESI-MS analysis.11 The shotgun method was later also used with offline separation and fraction collection on plates for MALDI-MS analysis. In 2003, Bodnar et al. reported that the complementary nature of ESI and MALDI data could be used to increase the number of proteins identified in a proteomic analysis.7 In a study of mammalian mitochondrial ribosomes, they found that adding MALDI analysis to ESI analysis gave a 27% increase in the total number of proteins identified. Subsequently, a series of other reports gave similar results.20-28 In general, adding MALDI analysis to the conventional ESI analysis in shotgun proteomics has been found to increase the number of identified proteins by 25% or more. The reported studies using both ESI and MALDI analysis required either splitting the LC effluent to collect fractions for MALDI analysis during an online ESI analysis or running a totally separate LC separation for the MALDI analysis. Either way requires more total sample, and is still subject to the time limitations of online ESI analysis. The new dual LDI-DESI ionization platform will utilize the same sample fractions (thus requiring no more sample for both modes), and will extend to the "ESI" mode (i.e. DESI in this case), the demonstrated advantages of removing the time constraint that has been demonstrated in offline MALDI analysis.17

LDI from Nanostructured Surfaces

Matrix-assisted laser desorption ionization (MALDI) mass spectrometry is a key method for analysis of biomolecules.5, 6 The matrix plays a crucial role in this technique by absorbing the laser light energy and desorbing the analyte into a gas phase. However, MALDI is complicated by the need to have good co-crystallization of analyte and matrix. Use of matrix often results in a heterogeneous co-crystallization of matrix and analyte that leads to non-uniformity in MS analysis. The choice of matrix is also crucial for optimal desorption/ionization. Matrix background interference for detecting molecules with mass lower than 600 Da further limits the applications of conventional MALDI. Matrix-free methods of LDI MS offer the potential to eliminate these complications.

Several types of nanostructured surfaces have been reported as alternatives to the use of matrix for LDI. Matrix-free surfaces can provide better uniformity and also can offer a low cost substitute for conventional MALDI targets. The ground-breaking work by Tanaka et al., which was honored by a Nobel Prize as the beginning of MALDI, actually employed a nanoparticulate (~300 Å diameter cobalt particles) suspended in a glycerol solution of analyte.29 Subsequently, surface-assisted laser desorption ionization (SALDI) was reported using a carbon suspension in an analyte solution in glycerol.30 Further studies demonstrated the utility of carbon SALDI for organic analysis,31 and in conjunction with thin-layer chromatography32 and solid-phase extraction.33 Reviews by Afonso et al., 34 Dattelbaum et al., 35 and Peterson36 describe various modified surfaces for LDI MS. Some of the demonstrated surfaces to date are porous silicon, 37, 38 porous silicon dioxide,39, 40 nanocrystalline titanium oxide (TiO2),41 porous alumina,42 porous polymer monolith,43 and structured carbon surfaces such as vertically aligned carbon nanotubes.44 It has been observed that submicrometer surface porosity, regardless of the surface material, is a key factor for promoting LDI of peptides.45 Among the reported surfaces, desorption ionization on porous silicon (DIOS) has received the ESI MALDI (a) 8 (16%) 32 (63%) 11 (22%) ESI MALDI (b) 369 (32.1%) 487 (42.4%) 293 (25.5%) MALDI added 27.5% more proteins MALDI added 34.2% more proteins most attention.37 Nanohorizons Inc. has developed matrix-free targets using both nanostructured silicon films and non-porous germanium layers.46, 47 Waters Inc. also offers MALDI-DIOS targets. DIOS chips show significantly less background signal noise at masses below 600 Da compared to MALDI.37 Several applications of DIOS to protein studies were reported by Thomas et al.,38 which included structural identification and characterization as well as study of protein catalyzed chemical transformations. While DIOS has been shown to be useful for a variety of applications, storage of DIOS chips can be problematic, because the silicon surface tends to form an oxide layer that reduces the signal intensity. This can be overcome by removing the surface oxide with hydrofluoric acid before use, but doing so is an additional complication to the use of DIOS.

LDI from metal coated porous alumina has also been reported.42 This report indicated that an electrically conductive layer is required for LDI on non-silicon surfaces. However, few details were provided and the report did not describe a systematic study of the experimental parameters controlling the signal intensity. Another report has described the use of nanoporous alumina membrane (without metal coating) as a very high density surface for MALDI analysis,48 but this work also used a conventional organic matrix. We recently carried out an initial systematic study of LDI-MS performance of porous alumina as a function of the surface parameters.8 This work is discussed under Preliminary Studies.

DESI MS Analysis

Desorption electrospray ionization (DESI) is a new atmospheric ionization method introduced by Cooks et al.49 in 2004 (see letter of support from Professor Cooks in Section L.). This method utilizes a pneumatically assisted electrospray (ES) ion source which is directed upon the surface to be analyzed. The charged liquid droplet spray and gas jet impinge upon the surface to be analyzed and desorb molecules from the surface into the gas phase. The gas phase ions generated from the desorbed species are collected by the inlet capillary or entrance orifice of an ESI-type mass spectrometer. The method has been demonstrated to work for a wide range of compounds ranging from small drug molecules to biopolymers.50, 51 Some of the reported applications of DESI include analysis of drugs (both dosage forms and residues),49, 52-55 explosives,56-59 chemical warfare simulants,58 industrial polymers,60 undiluted liquid streams,61 urinary metabolites,61, 62 alkaloids in plant tissue,63 protein folding,64 and even components of living animal tissue.65 Use of a spray solvent with reagent(s) that selectively react with an analyte of interest can be used for reactive DESI yielding as much as two orders of magnitude increase in sensitivity.66 DESI has been used to sample species on thin layer chromatography plates,67-69 and a recent report also showed DESI from nanoporous silicon.69 Nanoporous silicon could therefore also potentially be used a dual mode (DIOS and DESI) platform, but, as noted above, has the drawback of formation of surface oxide during storage.

Other Methods for ESI Surface Sampling

Van Berkel et al. have also developed another type of ESI interface for sampling from surfaces, including TLC plates.70-73 This interface utilizes a coaxial probe to direct a stream of solvent across a small area of the surface, which dissolves analyte from the surface prior to the electrospray. This type of interface is potentially amenable to use with the nanostructured surfaces and is also potentially amenable to miniaturization for sampling small spots, although it is expected that it would likely consume more sample than with the same area sampled by the DESI probe. Nonetheless, this type of ESI interface could be a fallback in case of unforeseen problems with the proposed DESI approach.

Ambient Mass Spectrometry

DESI is one of a growing number of methods for producing ions at ambient pressure prior to MS analysis, which is a rapidly developing area of mass spectrometry.51 Although ambient ion generation was being used as early as the 1980's, 74 there has been a recent resurgence of activity with development of new methods of ion generation. ESI is also an ambient ion generation method, but the recent era of sampling analytes from surfaces stems from the development of atmospheric pressure MALDI (AP-MALDI), which was first reported in 2000.75 Other ambient pressure ion generation methods include DART (direct analysis in real time),76 DAPCI (desorption atmospheric pressure chemical ionization),77 ASAP (atmospheric solids analysis probe),78 ELDI (electrospray-assisted laser desorption/ionization),79 and MALDESI (matrix-assisted laser desorption electrospray ionization).80

All of these methods have in common the need to efficiently collect the ions formed at ambient pressure and transmit them into the vacuum of the mass spectrometer for analysis. This need has led to a variety of approaches to improve the collection yield of the formed analyte ions using both electrostatic and hydrodynamic effects. The earliest work on AP-MALDI utilized an electric field around the collection capillary to direct the ion cloud toward the capillary.75 It was subsequently recognized that the field also resulted in loss of ions to the capillary surface leading to the development of pulsed dynamic focusing (PDF) where the field is switched off just before the pulse of ions reaches the collection capillary.81 The PDF approach is not applicable to non-pulsed methods, but other methods have been reported for generating continuous field free ion beams. Sheehan and Willoughby have developed a "remote reagent ion generator" which was recently introduced as a commercial product.82 This device delivers ions to an ambient source with little or no field. Goodley recently reported results on a triboelectric emitter that produces ions without an electrical field.83, 84 Although the reported ion current from this device was 100-fold less that for ESI, it may be possible to optimize the device for higher ion yield.

A series of approaches based upon hydrodynamic methods have also been found to improve ion collection yield. Simply flaring the inlet capillary improves ion yield for ESI, DESI, and AP-MALDI.85 Lee et al. introduced the use of an air flow amplifier to improve the conductance of ESI-produced ions into the entrance capillary,86 and Muddiman, et al. have further developed the applications of this device.87, 88 Foret, et al. recently reported an aerodynamic focusing device for interfacing a microfluidic ESI system.89 This device is essentially an airflow amplifier with a capillary sampling port attached to the entrance.

Efforts to improve ion yield using electric fields at ambient pressure include the use of a ring electrode between the ESI sprayer and capillary90, 91 or near the sprayer92, 93 and lenses or fields associated with the capillary itself94-96 Smith et al. introduced the ion funnel, which significantly improves ion transmission, but this device is used at reduced pressure stages of the ion transport and not in the ambient pressure region.97-99

More efficient collection of ions formed at ambient pressure remains an area offering significant opportunities for improvement of sensitivity in ambient mass spectrometry.

Preparation of Nanostructured Surfaces

Nanostructured thin films of various metal oxides have been reported using sol-gel methods or anodization of metal thin films. Formation of porous alumina structures by anodizing Al is now a well established technique. There are multiple reports on fabrication and characterization of porous anodic alumina structures that typically exhibit a uniform array of hexagonal cells, with each cell containing a cylindrical pore.100-103 It has been demonstrated that electropolishing the Al surface (reducing the surface roughness to several nanometers) prior to anodization improves the surface morphology.104 A multi-step anodization process also yields better uniformity.105 However, none of these reported studies were focused upon MS application. We recently reported an initial study on optimizing the preparation of porous alumina films for LDI analysis.8

Applications of Embodiments of the Invention

Proteomic studies offer great potential for identifying new markers of disease and gaining new understanding of biological processes that can lead to improved approaches to prevention and treatment of disease. Exploiting this potential is limited by the ability of present technologies to deal with the complexity and dynamic range of the protein mixtures encountered in living systems. Recent work indicates that the analytical challenge presented by shotgun proteomics is more than an order of magnitude greater than even previously assumed.12 Embodiments of the invention improve the analytical methodologies available for proteomic analysis. Dual mode LDI/DESI probe allows observation of more components of proteomic mixtures.

<Reference Set B-end>

Experimental

Standards and Chemicals

Bovine serum albumin (BSA), catalase (bovine), β-casein (bovine), horseradish peroxidase, iodoacetamide, dithiothreitol, and proteomic grade trypsin (20 μg vial) were purchased from Sigma Aldrich (St. Louis, Mo.). Ammonium bicarbonate (NH4HCO3), trifluoroacetic acid (TFA), phosphoric acid, isopropyl alcohol, acetonitrile, methanol, acetic acid, citric acid and HPLC grade water were purchased from ThermoFisher Scientific (Pittsburg, PA).

Protein Digest Preparation 2 mg of each protein sample was dissolved in 30 μL 0.1% SDS-50 mM Tris-HCl, and 100 μL of 100 mM NH4HCO3 solution. DTT (130 μL of 0.01 M) was added to the protein solution, the mixture was heated for 45 mins at 56° C., and then cooled to room temperature. Thereafter, 37 μL of 0.08 mM iodoacetamide solution was added, and the protein solution was incubated at room temperature for 30 min in darkness. The protein mixture was further diluted by adding 200 μL of 100 mM NH4HCO3 solution and incubated for 18 hr at 37° C. with trypsin at an enzyme to substrate ratio of 1:100 (w/w). The digestion reaction was quenched by adding 10 μL of 10% TFA. The final concentration of the protein digests was 3.9 mg/ml; the solutions were further diluted to 1 mg/ml for BSA and 0.35 mg/ml for the other proteins (catalase, β-casein and horseradish peroxidase) and then stored at −20° C.

Porous Alumina Surface Preparation

A detailed description of the preparation method for porous alumina surfaces and optimization of preparation parameters for LDI is found in Appendix A[13]. In brief, cleaned microscopic glass slides were coated with 0.6 μm aluminum (Al) film using thermal evaporation. The Al film on glass was anodized at 80 V at room temperature in 10 vol % phosphoric acid solution to form the porous alumina structure. The anodized samples were then cleaned in water and isopropyl alcohol and sputter coated with a thin gold layer (120 nm).

Instrumentation

MALDI and LDI MS analysis were performed on a Voyager STR-DE TOF mass spectrometer (Applied Biosystems, Foster City, Calif.). ESI and DESI analysis were performed on a ThermoFinnigan LCQ Classic ion trap mass spectrometer (ThermoFinnigan, San Jose, Calif.). A DESI/ESI ion source was constructed using a standard 1/16" Swagelok tee fitting. Two stainless steel capillary tubes, one as an inner capillary (ID—0.1 mm; OD—0.15 mm; length—30 mm) that directs the solvent to the emitter and a short outer capillary (ID—0.25 mm; OD—0.4 mm; length—15 mm) for delivering the nebulization gas, were connected to the two coaxial ends of the tee fitting. A helium gas (nebulizer) line was connected to the third connector on the tee. The free end of the inner capillary was connected to a 250 μl Hamilton syringe (driven by a syringe pump). For DESI operation, the ion source was attached with a positioning stage having free movement along x-y directions. The porous alumina surface was placed on an acrylic platform as a part of the sample holder, which insulated the surface from rest of the system. The angle between the emitter and the substrate platform could be varied from zero to 90°. The standard LCQ ion inlet capillary was used without any modification.

Matrix-assisted laser desorption ionization (MALDI) mass spectrometry

MALDI matrix was prepared by dissolving 7 mg/ml alpha-cyano-4-hydroxycinnamic acid (CHCA) in 30% acetonitrile. 0.5 μl of each protein digest sample (dissolved in 50 mM citric acid) was spotted on a standard MALDI plate and dried in air. An equal volume of CHCA matrix solution was spotted on the dried sample.

Laser Desorption Ionization (LDI) Mass Spectrometry

LDI MS analysis on porous alumina surface was done by sticking the substrate (using a conductive copper tape) onto a standard MALDI plate with a 25 mm×25 mm×1 mm depression milled at the center. The same protein digest samples were analyzed as 0.5 μl aliquots dried onto the porous alumina surface.

Electrospray Ionization (ESI) Mass Spectrometry

The electrospray source, described in the instrumentation section above, was used for ESI analysis by mounting it on a x-y-z movable stage and directing the spray onto the inlet capillary. The LCQ ESI high voltage was applied to the ion source. Protein digest samples dissolved in methanol:water:

acetic acid (48:48:4) solution were infused into the inner tube by a syringe pump. A sheath gas (Helium) was used to assist the ionization process and stabilize the spray fed through the outer capillary.

Desorption Electrospray Ionization (DESI) Mass Spectrometry

Each protein digest was spotted on the porous alumina surface and placed on the movable platform of the sample holder to adjust its position relative to the MS capillary inlet. The ion source was positioned at 34° with respect to the sample surface and connected to a high voltage supply source. A spray solvent (methanol:water:acetic acid—48:48:4) was fed into the inner capillary of the emitter using a syringe pump. Helium nebulization gas was carried through the outer capillary. The spray generated from the tip of the emitter was directed towards the sample surface to ionize the sample. The desorbed ions were collected using the standard LCQ collection capillary.

Results and Discussion

Four tryptic digested proteins were analyzed (molecular weight varying from 23 kDa to 67 kDa) by MS using four different ionization methods: ESI, MALDI, DESI and LDI. A protein sequence database search program (UCSF Protein Prospector, http://prospector.ucsf.edu) was used to fit the observed peptide fragment masses to individual protein sequences (allowing up to two missed cleavages and a mass tolerance of ±1.0 Da). Conventional MALDI and ESI results were compared with LDI and DESI results using the porous alumina target. A summary of the observed fragment peptide peaks from the digested proteins using the different methods are shown in Tables 1 to 4 (supplementary data). FIGS. 1 (*a, b, c* & *d*) show the mass spectra of the bovine catalase digest (0.35 mg/ml) obtained from MALDI, ESI, LDI and DESI methods respectively. The matched peaks are labeled in the figures.

Figure 2:
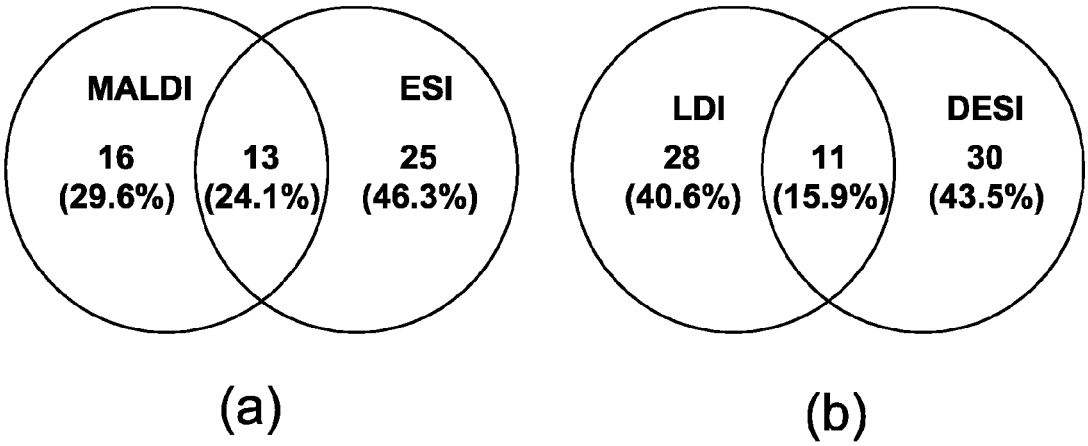
FIG. 2 is a venn diagram of (a) MALDI/ESI, and (b) LDI/DESI data from bovine catalase digest. The numbers indicate number of peptides observed by the methods and the percentages of the total observed peptides.

The data analysis in FIG. 1 indicates that, MALDI and ESI observed 16 and 25 unique peptides respectively and 13 common to both methods. LDI and DESI observed 28 and 30 unique peptides and 11 in common. These results are pictorially represented in Venn diagrams in FIG. 2 (*a* & *b*).

Figure 3:
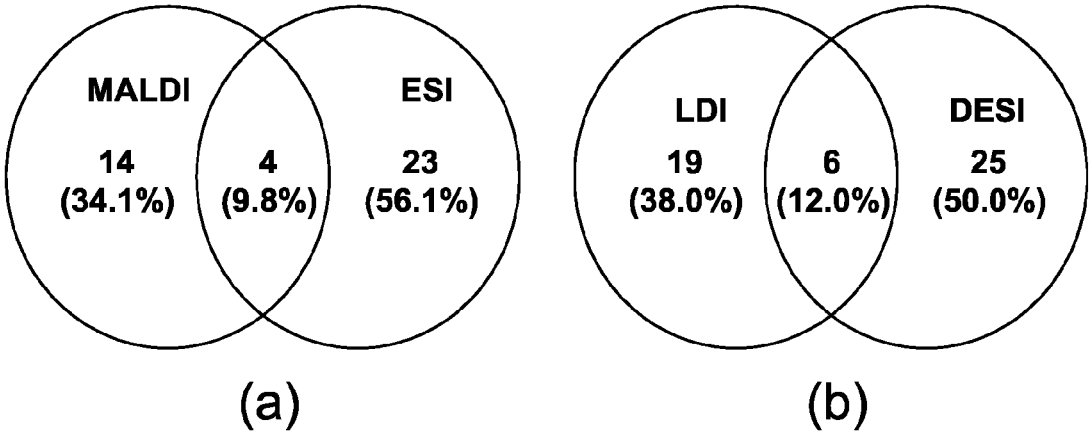
FIG. 3 is a venn diagram of (a) MALDI/ESI, and (b) LDI/DESI data from β-casein (bovine) digest. The numbers indicate number of peptides observed by the methods and the percentages of the total observed peptides.
Figure 4:
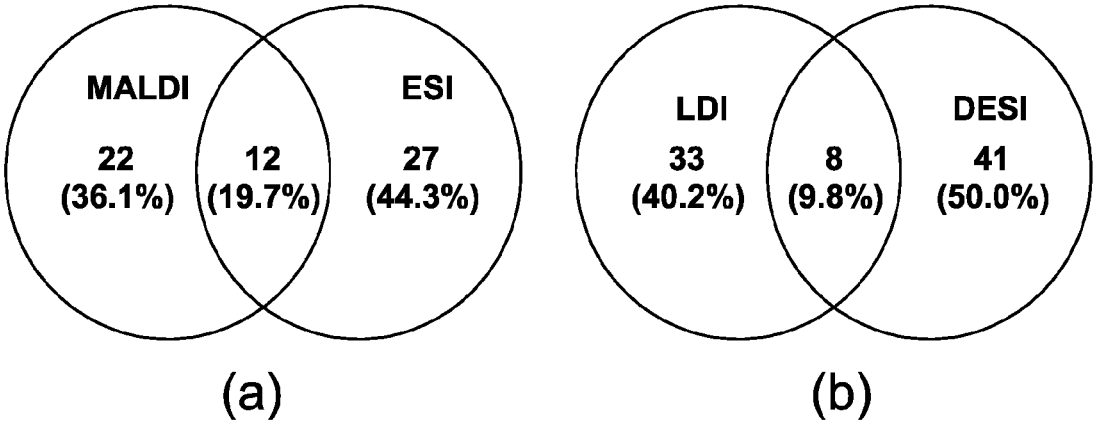
FIG. 4 is a venn diagram of (a) MALDI/ESI, and (b) LDI/DESI data from horseradish peroxidase digest. The numbers indicate number of peptides observed by the methods and the percentages of the total observed peptides.
Figure 5:
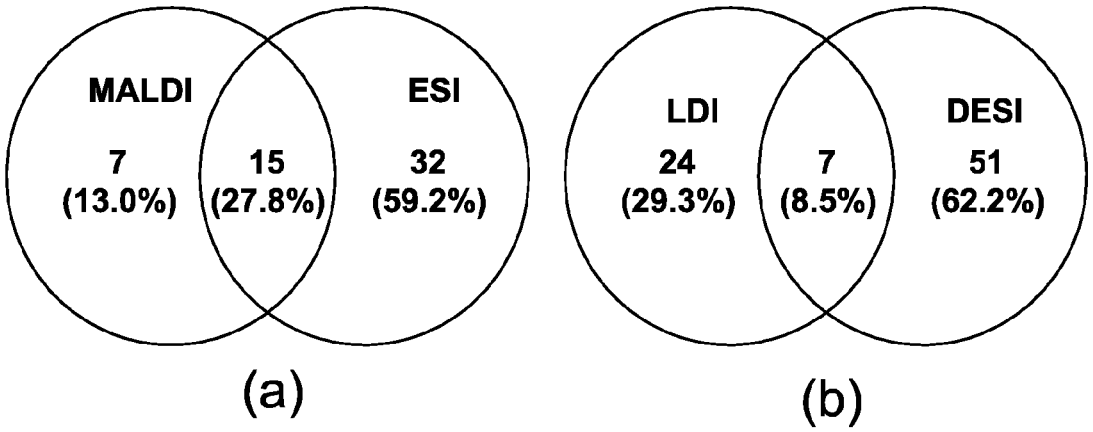
FIG. 5 is a venn diagram of (a) MALDI/ESI, and (b) LDI/DESI data from bovine serum albumin digest. The numbers indicate number of peptides observed b the methods ///and the percentages of the total observed peptides.

FIG. 2*a* shows that by adding MALDI analysis with ESI, there was an increase of 29.6% in the number of peptides observed. Adding LDI MS analysis with DESI (FIG. 2*b*) gave 40.6% increase in the peptide identification. Further, the dual LDI/DESI technique observed a greater number of total peptides (69) compared to the combined ESI/MALDI approach (54). MS fit search on the other three proteins also resulted in similar trend of increase in the total number of observed peptides using dual DESI-LDI approach as represented in the Venn diagrams in FIGS. 3, 4 and 5 (further details in tabular form shown in supplementary data).

The dual ionization approach on a single platform offers a shorter and simpler process than conventional ESI and MALDI, which requires two separate sample preparations. The approach also requires less sample. Combination of ESI and MALDI analysis (as reported from earlier studies) required either splitting the LC (liquid chromatography) effluent to collect fractions for MALDI analysis during an online ESI analysis or running a totally separate LC separation for the MALDI analysis. Either way requires more sample and is still subject to the time limitations of online ESI analysis, particularly when both MS and MS/MS data are being acquired. As observed from previous studies on dual mode ionization, it was found that MALDI MS provides limited sequence coverage, due the ionization efficiency often depending on the choice of matrix and several other factors [4, 6]. Lower sequence coverage can often lead to false identification of unknown proteins. Most of the studies indicating higher peptide coverage using traditional MALDI and ESI, have also done MS/MS analysis for further identification of the proteins, because these studies were based on identifying unknown proteins from biological samples. In the present study, MS/MS database search was not performed because only known proteins were examined.

The DESI spectra in our work show a higher noise level than spectra obtained using the other ionization methods. These data were obtained with an improvised DESI source that was not fully optimized and utilized the existing LCQ ion inlet capillary. Improvement in the DESI source would be expected to yield a better S/N ratio, which could lead to still better sequence coverage using DESI. Overall, replacing the traditional methods of MALDI and ESI following either 2DE or 2D-LC with the dual LDI/DESI method could prove both time and cost effective as well as yield greater depth of analysis. Further work will be undertaken using an optimized DESI source and examining real biological samples.

CONCLUSIONS

It was found that LDI/DESI observes more peptides than either method performed alone and also more than combination of MALDI and ESI. It is recognized that an unseparated digest mixture is different from an RP-LC fraction mixture in that the former contains a wider range of peptides in terms of hydrophobicity. The use of LDI/DESI on a common platform is a useful method for increasing the coverage of observed peptides in shotgun proteomic analysis.

REFERENCES

[1] Bodnar W M, Blackburn R K, Krise J M, Moseley M A. Exploiting the complementary nature of LC/MALDI/MS/MS and LC/ESI/MS/MS for increased proteome coverage. J Am Soc Mass Spectrom 2003; 14:971-979.

[2] Anderson N L, Anderson N G. The human plasma proteome: history, character, and diagnostic prospects. Mol Cell Proteomics 2002; 1:845-867.

[3] Heller M, Mattou H, Menzel C, Yao X. Trypsin catalyzed 16O-to-18O exchange for comparative proteomics: tandem mass spectrometry comparison using MALDI-TOF, ESI-QTOF, and ESI-ion trap mass spectrometers. J Am Soc Mass Spectrom 2003; 14:704-718.

[4] Zhu K, Kim J, Yoo C, Miller F R, Lubman D M. High sequence coverage of proteins isolated from liquid separations of breast cancer cells using capillary electrophoresis-time-of-flight MS and MALDI-TOF MS mapping. Anal Chem 2003; 75:6209-6217.

[5] Stapels M D, Barofsky D F. Complementary use of MALDI and ESI for the HPLC-MS/MS analysis of DNA-binding proteins. Anal Chem 2004; 76:5423-5430.

[6] Yoo C, Pal M, Miller F R, Barder T J, Huber C, Lubman D M. Toward high sequence coverage of proteins in human breast cancer cells using on-line monolith-based HPLC-ESI-TOF MS compared to CE MS. Electrophoresis 2006; 27:2126-2138.

[7] Wei J, Buriak J M, Siuzdak G. Desorption-ionization mass spectrometry on porous silicon. Nature 1999; 399:243-246.

[8] Thomas J J, Shen Z, Crowell J E, Finn M G, Siuzdak G. Desorption/ionization on silicon (DIOS): a diverse mass spectrometry platform for protein characterization. Proc Natl Acad Sci U S A 2001; 98:4932-4937.

[9] Gorecka-Drzazga A, Bargiel S, Walczak R, et al. Desorption/ionization mass spectrometry on porous silicon dioxide. Sensors and Actuators, B: Chemical 2004; B103:206-212.

[10] Iyer S, Dattelbaum A M, Sample desorption/ionization from mesoporous silica. Application: US: (The Regents of the University of California, USA). 2005: 12 pp.

[11] Chen C T, Chen Y C. Desorption/ionization mass spectrometry on nanocrystalline titania sol-gel-deposited films. Rapid Commun Mass Spectrom 2004; 18:1956-1964.

[12] Okuno S, Arakawa R, Okamoto K, et al. Requirements for laser-induced desorption/ionization on submicrometer structures. Anal Chem 2005; 77:5364-5369.

[13] Nayak R, Knapp DR. Effects of Thin-Film Structural Parameters on Laser Desorption/Ionization from Porous Alumina. Anal Chem 2007.

[14] Peterson D S, Luo Q, Hilder E F, Svec F, Frechet J M. Porous polymer monolith for surface-enhanced laser desorption/ionization time-of-flight mass spectrometry of small molecules. Rapid Commun Mass Spectrom 2004; 18:1504-1512.

[15] Shin S J, Choi D-W, Kwak H-S, Lim G I, Choi Y S. Matrix-free laser desorption/ionization on vertically aligned carbon nanotube arrays. Bulletin of the Korean Chemical Society 2006; 27:581-583.

[16] Takats Z, Wiseman J M, Gologan B, Cooks R G. Mass spectrometry sampling under ambient conditions with desorption electrospray ionization. Science 2004; 306:471-473.

[17] Takats Z, Wiseman J M, Cooks R G. Ambient mass spectrometry using desorption electrospray ionization (DESI): instrumentation, mechanisms and applications in forensics, chemistry, and biology. J Mass Spectrom 2005; 40:1261-1275.

[18] Takats Z, Cotte-Rodriguez I, Talaty N, Chen H, Cooks R G. Direct, trace level detection of explosives on ambient surfaces by desorption electrospray ionization mass spectrometry. Chem Commun (Camb) 2005:1950-1952.

[19] Cotte-Rodriguez I, Takats Z, Talaty N, Chen H, Cooks R G. Desorption electrospray ionization of explosives on surfaces: sensitivity and selectivity enhancement by reactive desorption electrospray ionization. Anal Chem 2005; 77:6755-6764.

[20] Talaty N, Takats Z, Cooks R G. Rapid in situ detection of alkaloids in plant tissue under ambient conditions using desorption electrospray ionization. Analyst 2005; 130: 1624-1633.

[21] Kauppila T J, Wiseman J M, Ketola R A, Kotiaho T, Cooks R G, Kostiainen R. Desorption electrospray ionization mass spectrometry for the analysis of pharmaceuticals and metabolites. Rapid Commun Mass Spectrom 2006; 20:387-392.

[22] Weston D J, Bateman R, Wilson I D, Wood T R, Creaser C S. Direct analysis of pharmaceutical drug formulations using ion mobility spectrometry/quadrupole-time-of-flight mass spectrometry combined with desorption electrospray ionization. Anal Chem 2005; 77:7572-7580.

[23] Williams J P, Scrivens J H. Rapid accurate mass desorption electrospray ionisation tandem mass spectrometry of pharmaceutical samples. Rapid Commun Mass Spectrom 2005; 19:3643-3650.

[24] Kauppila T J, Talaty N, Salo P K, Kotiaho T, Kostiainen R, Cooks R G. New surfaces for desorption electrospray ionization mass spectrometry: porous silicon and ultra-thin layer chromatography plates. Rapid Commun Mass Spectrom 2006; 20:2143-2150.

[25] Sen A K, Nayak R, Darabi J, Knapp D R, Desorption Electrospray Ionization using a Porous Alumina. Summer Bioengineering conference. Keystone, Colorado, USA, 2007.

TABLE 1

Listing of BSA tryptic fragments and tabular summary of data from ESI, MALDI, DESI, and LDI

| | m/z observed ESI | m/z observed MALDI | m/z observed DESI on porous alumina | m/z observed LDI on porous alumina | $MH^+$ matched | Missed cleavages | Sequence |
|---|---|---|---|---|---|---|---|
| 1 | | | | 259.88 | 260.20 | 0 | (K)LK(E) |
| 2 | | | | 302.53 | 303.18 | 0 | (R)QR(L) |
| 3 | | | 331.20 | | 331.23 | 0 | (R)ALK(A) |
| 4 | | | 404.20 | | 404.25 | 0 | (R)SLGK(V) |
| 5 | | | | 433.08 | 432.26 | 0 | (K)VGTR(C) |
| 6 | 439.65 | | | | 439.23 | 0 | (R)YTR(K) |
| 7 | 475.28 | | 475.80 | | 475.29 | 0 | (R)LSQK(F) |
| 8 | 508.34 | 509.09 | 508.30 | | 508.25 | 0 | (K)FGER(A) |
| 9 | | | | 522.13 | 521.24 | 0 | (K)DVCK(N) |
| 10 | | | | 537.59 | 537.28 | 0 | (K)FWGK(Y) |
| 11 | 545.29 | | 545.50 | | 545.34 | 0 | (K)VASLR(E) |
| 12 | 567.24 | 568.20 | | 566.79 | 567.32 | 1 | (R)YTRK(V) |
| 13 | | | 591.20 | | 590.32 | 1 | (K)ADEKK(F) |
| 14 | 609.31 | | 609.40 | 609.48 | 609.29 | 0 | (K)AFDEK(L) |
| 15 | | | | 635.28 | 634.38 | 1 | (R)GVFRR(D) |
| 16 | | | | 648.50 | 649.33 | 0 | (K)IETMR(E) |
| 17 | 665.33 | 664.78 | 665.20 | | 665.38 | 1 | (K)KFWGK(Y) |
| 18 | | 690.23 | 689.70 | | 689.37 | 0 | (K)AWSVAR(L) |
| 19 | 700.44 | | | | 701.40 | 0 | (K)GACLLPK(I) |
| 20 | 712.33 | 712.94 | | | 712.37 | 0 | (K)SEIAHR(F) |
| 21 | 752.40 | | | 752.92 | 752.36 | 0 | (K)NYQEAK(D) |
| 22 | 789.42 | | 789.50 | 790.15 | 789.47 | 0 | (K)LVTDLTK(V) |
| 23 | 818.39 | | | | 818.42 | 0 | (K)ATEEQLK(T) |
| 24 | | | 821.10 | | 820.47 | 1 | (K)FGERALK(A) |
| 25 | 847.46 | | 847.60 | 847.03 | 847.50 | 1 | (R)LSQKFPK(A) |

TABLE 1-continued

Listing of BSA tryptic fragments and tabular summary of data from ESI, MALDI, DESI, and LDI

| | m/z observed ESI | m/z observed MALDI | m/z observed DESI on porous alumina | m/z observed LDI on porous alumina | $MH^+$ matched | Missed cleavages | Sequence |
|---|---|---|---|---|---|---|---|
| 26 | 899.33 | | | | 898.48 | 0 | (R)LCVLHEK(T) |
| 27 | | | | 917.54 | 918.52 | 1 | (R)LRCASIQK(F) |
| 28 | 922.41 | | | | 922.49 | 0 | (K)AEFVEVTK(L) |
| 29 | | 927.28 | 927.60 | | 927.49 | 0 | (K)YLYEIAR(R) |
| 30 | | | | 960.53 | 960.55 | 1 | (R)EKVLASSAR(Q) |
| 31 | | 986.63 | | 987.34 | 987.54 | 1 | (K)SEIAHRFK(D) |
| 32 | 1002.39 | | 1002.60 | 1001.06 | 1001.59 | 1 | (R)ALKAWSVAR(L) |
| 33 | | | 1024.70 | | 1024.46 | 0 | (K)CCTESLVNR(R) |
| 34 | | 1053.33 | 1051.60 | | 1051.41 | 0 | (R)CCTKPESER(M) |
| | | | | | 1052.45 | | |
| 35 | | | | 1114.71 | 1115.61 | 2 | (R)GVFRRDTHK(S) |
| 36 | 1142.62 | | 1142.60 | | 1143.55 | 1 | (K)KQTALVELLK(H) |
| 37 | 1163.53 | 1163.11 | 1163.70 | | 1163.63 | 0 | (K)LVNELTEFAK(T) |
| 38 | | | 1202.80 | | 1202.68 | 2 | (R)QRLRCASIQK(F) |
| 39 | 1249.47 | 1249.27 | 1249.30 | 1241.65 | 1240.62 | 1 | (R)FKDLGEEHFK(G) |
| | | | | | 1249.62 | | |
| 40 | | | 1283.50 | | 1283.71 | 0 | (R)HPEYAVSVLLR(L) |
| 41 | 1305.64 | 1305.46 | | | 1305.72 | 0 | (K)HLVDEPQNLIK(Q) |
| 42 | | | | 1309.53 | 1308.77 | 1 | (K)HKPKATEEQLK(T) |
| 43 | | | 1332.40 | | 1331.72 | 1 | (K)GACLLPKIETMR(E) |
| 44 | 1420.41 | | 1420.50 | | 1419.69 | 0 | (K)SLHTLFGDELCK(V) |
| 45 | 1439.70 | 1439.60 | | | 1439.81 | 1 | (R)RHPEYAVSVLLR(L) |
| 46 | 1479.73 | 1479.18 | 1479.80 | | 1479.80 | 0 | (K)LGEYGFQNALIVR(Y) |
| 47 | 1491.50 | | | | 1490.82 | 2 | (K)FGERALKAWSVAR(L) |
| 48 | | 1499.59 | | | 1498.62 | 0 | (K)DDPHACYSTVFDK(L) |
| 49 | | | | 1508.73 | 1507.81 | 2 | (R)CASIQKFGERALK(A) |
| 50 | 1537.54 | 1537.95 | | | 1537.75 | 1 | (K)VTKCCTESLVNR(R) |
| 51 | | 1539.89 | 1540.70 | | 1539.82 | 1 | (R)LCVLHEKTPVSEK(V) |
| 52 | 1567.67 | 1566.96 | 1567.60 | | 1567.74 | 0 | (K)DAFLGSFLYEYSR(R) |
| 53 | | | | 1576.53 | 1576.77 | 0 | (K)LKPDPNTLCDEFK(A) |
| 54 | | | | 1579.41 | 1579.73 | 1 | (K)VGTRCCTKPESER(M) |
| 55 | 1595.92 | | | | 1595.93 | 1 | (R)HPEYAVSVLLRLAK(E) |
| 56 | 1905.04 | | | 1635.13 | 1635.62 | 0 | (K)ECCHGDLLECADDR(A) |
| | | | | | 1905.75 | | |
| 57 | 1639.83 | 1639.01 | 1640.90 | | 1639.94 | 1 | (R)KVPQVSTPTLVEVSR(S) |
| 58 | 1667.99 | | | | 1667.81 | 0 | (R)MPCTEDYLSLILNR(L) |
| 59 | | 1692.80 | | | 1692.94 | 1 | (K)AEFVEVTKLVTDLTK(V) |
| 60 | | | | 1811.05 | 1811.01 | 2 | (R)LCVLHEKTPVSEKVTK(C) |
| 61 | 1881.76 | 1880.62 | | | 1880.92 | 0 | (R)RPCFSALTPDETYVPK(A) |
| 62 | | | 1943.10 | | 1942.82 | 1 | (K)VHKECCHGDLLECADDR(A) |
| 63 | | | | 1973.23 | 1972.91 | 1 | (R)NECFLSHKDDSPDLPK(L) |

I claim:

1. A method of proteomic analysis comprising analyzing a protein or peptide with a dual ionization mode mass spectrometric device, wherein said device comprises desorption electrospray ionization (DESI) and laser desorption ionization (LDI), and wherein the device comprises a nanoporous alumina surface.

2. The method of claim 1 wherein said nanoporous alumina surface is gold coated.

3. The method of claim 2 wherein the resulting spectra from DESI and LDI are combined to report a total number of observed peptides.

4. A dual ionization mode mass spectrometric device for proteomic analysis comprising a nanoporous alumina surface, wherein said device further comprises desorption electrospray ionization (DESI) and laser desorption ionization (LDI).

5. The device of claim 4 further comprising one sample of proteomic material for analysis.

* * * * *